United States Patent [19]

Komatsu et al.

[11] 4,197,778

[45] Apr. 15, 1980

[54] MUSIC BOX

[75] Inventors: Fumito Komatsu, Shiojiri; Takeo Saito, Okaya; Nobuaki Wakabayashi, Suwa, all of Japan

[73] Assignee: Kabushiki Kaisha Sankyo Seiki Seisakusho, Japan

[21] Appl. No.: 911,395

[22] Filed: Jun. 1, 1978

[30] Foreign Application Priority Data

Jun. 3, 1977 [JP] Japan ..... 52-72063[U]
Jun. 6, 1977 [JP] Japan ..... 52-73505[U]

[51] Int. Cl.[2] ..... G10F 1/06
[52] U.S. Cl. ..... 84/95 R; 84/96
[58] Field of Search ..... 84/94, 95, 96, 408

[56] References Cited

U.S. PATENT DOCUMENTS

| | | | |
|---|---|---|---|
| 1,961,369 | 6/1934 | Lauter | 84/95 |
| 2,634,649 | 4/1953 | Nemeth | 84/408 |
| 3,299,763 | 1/1967 | Glass et al. | 84/95 |
| 3,390,599 | 7/1968 | Komatsu | 84/96 |
| 3,688,626 | 9/1972 | Cotey | 84/95 |
| 4,071,364 | 1/1978 | Clark et al. | 84/96 X |

*Primary Examiner*—Lawrence R. Franklin
*Attorney, Agent, or Firm*—McGlew and Tuttle

[57] ABSTRACT

A music box includes a casing molded from synthetic resin material, to which a diaphragm is secured with a metallic resonator plate interposed therebetween. Sound produced by the diaphragm causes a resonance of the plate and additionally of the casing, giving off an amplified, clear sound externally.

18 Claims, 15 Drawing Figures

MUSIC BOX

BACKGROUND OF THE INVENTION

1. Field of the Invention

The present invention relates, in general to music boxes and, in particular, to a new and useful improvement for the movement of a music box.

2. Description of the Prior Art

A movement of a conventional music box comprises a die-cast base, a diaphragm mounted on the base, a drum having an array of integral pins which are disposed on the drum periphery according to a predetermined program to operate or flip the diaphragm, and a gear train which drives the drum. These components are contained in a protective casing which may be molded from synthetic resin material. The resulting casing may be assembled into a doll or sewn toy. The base of such movement is formed as a die-cast work since a high rigidity and density is required to serve as a support for the diaphragm, which can be satisfied by a die-cast work. If the support for the diaphragm has a reduced rigidity and density, there results a poor resonance, which is inadequate to produce an amplified, clear tone. While this consideration justifies the use of a die casting for the base of the movement, it stands in the way of the simplification and economy of the manufacture and assembly of parts, thus limiting a possible reduction in the manufacturing cost.

Music toys are also known which involve a motion of the hand or foot of a doll as a music box is being played. In conventional music toys, the drive to move the hand or foot of a doll is derived from an external output shaft which is integrally embedded into the drum of the music box in alignment with the center axis thereof. Consequently, when the music box is to be used in a music toy, the drum must be specially designed for use in that music toy. This results in a complex production control and maintenance of the parts in the assembly line of music boxes. Additionally, since the output shaft has a varying length depending on the kind or specification of the music toys, it has been necessary to provide drums having different lengths for their output shafts.

SUMMARY OF THE INVENTION

It is an object of the invention to provide a music box capable of producing an amplified, clear tone while allowing a reduction in the manufacturing cost through the simplification of the manufacture and assembly of parts.

It is another object of the invention to provide a music box which employs a thin sheet for the diaphragm that can be easily machined and which includes a drum and a gear train which can be easily assembled.

It is a further object of the invention to provide a music box which can be manufactured according to a standard specification and into which an external output shaft can be assembled as desired during or after the assembly, thus facilitating the maintenance of stock parts even with changes in the specification.

In accordance with the invention, the music box includes a diaphragm which is secured to a casing molded from synthetic resin material with a metallic resonating plate interposed therebetween. Also in accordance with the invention, the music box includes a drum which is formed with a central bore aligned with the axis of rotation thereof, the bore being open at least at its one end. The bore may be provided having an anchorage with an external output shaft which is inserted as required. A hollow bearing may be disposed within the open end of the bore to support the drum in a rotatable manner. An external shaft can be inserted into the central bore through the hollow bearing and the open end of the bore.

With the arrangement of the invention, an amplified, clear tone can be produced from the music box by merely interposing the resonating plate between the diaphragm and the casing, thus avoiding the need for a die-cast base as in the conventional arrangement. Consequently, the assembly and the manufacture or machining of parts are greatly facilitated, allowing the manufacturing cost to be reduced. In addition, the tone produced by the music box is of a comparable quality as that produced by a music box using a die-cast base.

When the music box of the invention is used in a music toy, the drum may be of a single standard type and size. Thus the production control is simplified, requiring a single mold for the manufacture of the drum and allowing a reduction in the manufacturing cost. Since an external output shaft can be mounted and dismounted after the assembly, a change in the specification can be freely made.

The various features of novelty which characterize the invention are pointed out with particularity in the claims annexed to and forming a part of this disclosure. For a better understanding of the invention, its operation advantages and specific objects attained by its uses, reference is made to the accompanying drawings and descriptive matter in which preferred embodiments of the invention are illustrated.

DETAILED DESCRIPTION OF PREFERRED EMBODIMENTS

Referring to FIGS. 1 to 5, there is shown a movement of a music box which comprises a substantially square-shaped base 1 and a cover 2 disposed in overlying relationship with the base, these members being molded from synthetic resin material. The base and cover define a space within which the movement is received. In its left-hand bottom portion, as viewed in FIG. 1, the base 1 is formed with a raised step 3. A resonating plate 4 is formed of a relatively thick iron plate and has its one end 4*a* folded twice along a pair of parallel, oblique lines and the end 4*a* is formed with a notch in its lateral edge, which is fitted around a projection 3*a* integral with the step, thereby fixedly mounting the plate 4 on the base 1. The resonating plate 4 includes a body 4*b* which is formed with a notch in its lateral edge which is similarly fitted around a projection 5 integrally formed with the base 1, thus securing the plate to the base. An upstanding piece 4*c* is formed on the free end of the body 4*b*, the end face of which is disposed in abutting relationship with a projecting step 2*a* of the cover 2 to hold the plate 4 against the base 1, thus maintaining the plate 4 and the base 1 integrally as a result of the fitting engagement mentioned above. It is to be noted that a threaded bore is formed in the end 4*a*.

Figure 7:
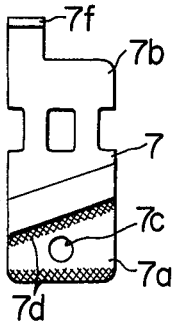
FIG. 7 is a bottom view of a resonating plate.
Figure 8:
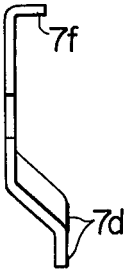
FIG. 8 is a left-hand side elevation thereof.
Figure 9:
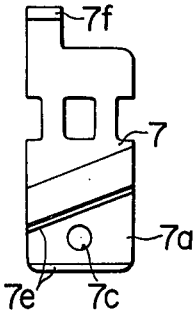
FIG. 9 is a bottom view of another form of resonating plate.
Figure 10:
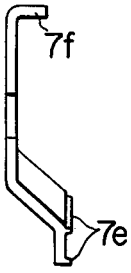
FIG. 10 is a left-hand side elevation thereof.
Figure 4:
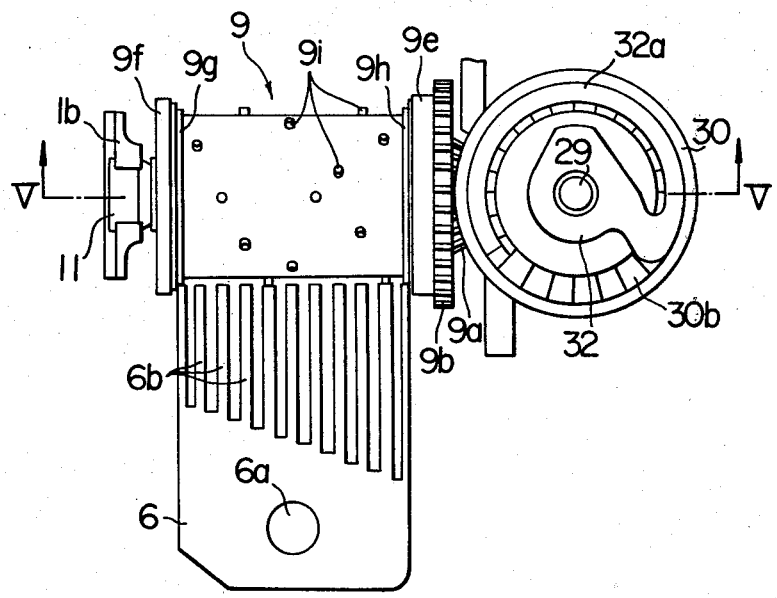
FIG. 4 is a plan view illustrating the relationship between the diaphragm and the drum.

One end of a diaphragm 6 is placed atop the end 4*a*, and another resonating plate 7 which is formed in the similar manner as the resonating plate 4 has its one end 7*a* placed on top of the diaphragm 6. The diaphragm 6 is formed with an opening 6*a* (see FIG. 4) in its end portion which abuts against the end 4*a* of the resonating plate while the end 7*a* of the resonating plate 7 is similarly formed with an opening 7*c* (see FIGS. 7 and 9). A headed screw 8 is passed through these openings and is threadably engaged with the threaded bore formed in the resonating plate 4, thus maintaining the end of the diaphragm 6 sandwiched between the ends 4*a*, 7*a* of the two resonating plates 4, 7. As is well recognized, the diaphragm 6 comprises a metal sheet in which a plurality of slits of sequentially varying lengths are formed extending from one side of the sheet to provide a plurality of diaphragm portions which are arranged according to a musical scale. A relatively thick sheet is usually employed for the diaphragm in order to prevent the acoustical attenuation and degradation in the tone quality which are caused by the damping effect of its end where it is mounted. In the region of the diaphragm portions, the sheet is reduced in thickness by machining. However, in accordance with the invention, a thin sheet can be used for the diaphragm, or the sheet may be formed as a press work since one end of the diaphragm is rigidly held between the ends 4*a*, 7*a* of the resonating plates 4, 7 having a substantial thickness, whereby the damping effect of the end of the diaphragm 6 is effectively prevented. However, when the common end of the diaphragm portions is not sufficiently firmly secured, there may be an incomplete suppression of the damping effect which may give rise to the oscillation of adjacent diaphragm portions, causing indistinct tone. As illustrated by the resonating plate 7 shown in FIGS. 7 and 8, it is recommended that it be knurled as shown at 7*d* in the surface thereof against which the diaphragm 6 bears. Alternatively, the plate may be formed with dams 7*e* as shown in FIGS. 9 and 10, in order to limit the area against which the diaphragm 6 bears.

At its free end, the resonating plate 7 is formed with a folded piece 7*f*, the end face of which is disposed in abutment against the step 1*a* projecting from the base 1 so as to be held between the base and the cover. When the base 1 and cover 2 are firmly fastened together by using a suitable number of set screws 10 (see FIG. 1), the resonating plate 7 can be said to be substantially integral with the cover 2.

The diaphragm portions extend into the space defined by the pair of resonating plates 4, 7, and a drum 9 is rotatably mounted therein. As is known, the drum 9 is provided with a plurality of pins 9*i* which are disposed around the periphery thereof according to a given program. These pins sequentially flip the diaphragm portions to play a desired music. The drum includes a bevel gear 9*a* to which a drive is transmitted from a prime mover, and also includes a gear 9*b* which transmits the drive to a governor assembly. In the example shown, the end face, adjacent which the gears 9*a*, 9*b* are formed, is centrally provided with a shaft 9*c* (see FIG. 5) while the other end face is centrally formed with an axial bore 9*d*. The shaft 9*c* is loosely fitted in a bore formed in a suitable vertical wall 33 of the base 1. A bearing 11 extending through a peripheral wall 1*b* of the base 1 includes a conical portion 11*a* which is fitted into the axial bore 9*d*, thus rotatably supporting the drum 9. The opposite ends of the drum are formed with flanges 9*e* and 9*f* which are juxtaposed with steps 9*g* and 9*h* located internally thereof. The pins 9*i* have an outer radius which is slightly greater than the radius of the steps 9*g*, 9*h*. The drum inclusive of the pins 9*i* may be integrally molded from synthetic resin material.

Figure 1:
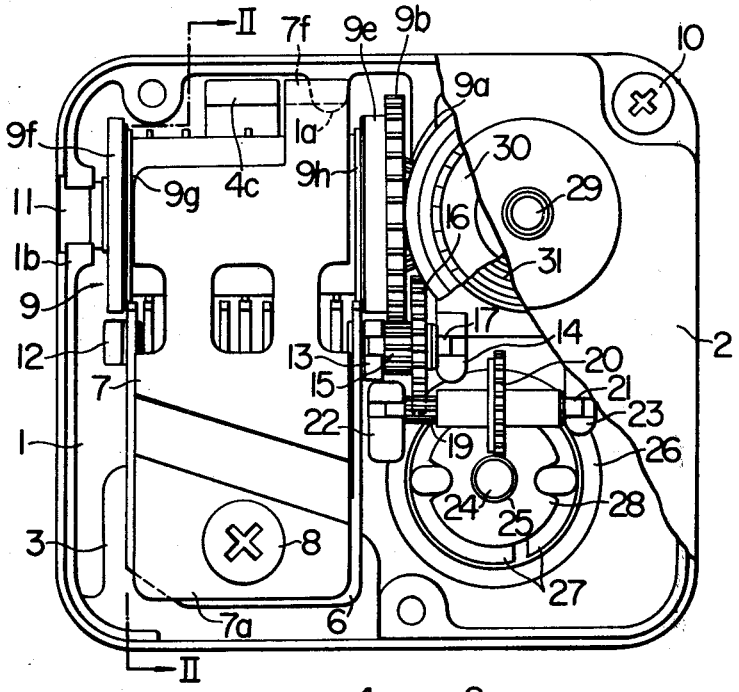
FIG. 1 is a plan view, partly broken away, of an embodiment of the invention.
Figure 2:
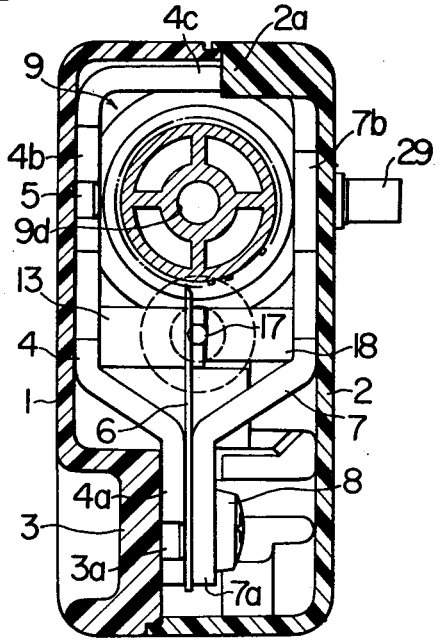
FIG. 2 is a cross section taken along the line II—II shown in FIG. 1.
Figure 3:
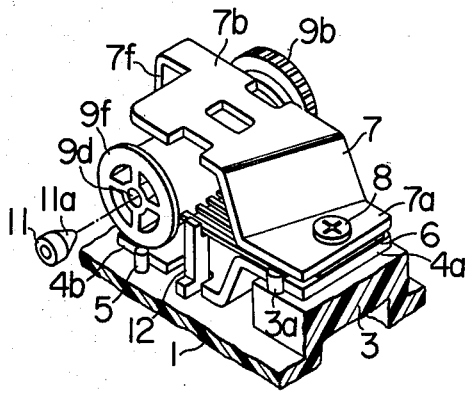
FIG. 3 is a perspective view of a diaphragm used in the embodiment of FIG. 1.
Figure 6:
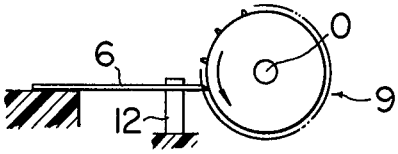
FIG. 6 is a right-hand side elevation illustrating the relationship between the diaphragm and the drum.

As mentioned previously, the diaphragm 6 which cooperates with the drum to produce sound includes a plurality of comb-shaped diaphragm portions 6*b*. In the embodiment shown, the pair of diaphragm portions which are located at the opposite ends do not contribute to the generation of sound. When securing the diaphragm between the resonating plates, they are used in the positioning of the diaphragm 6 by placing the ends of these diaphragm portions in abutment against the steps 9*g*, 9*h* and placing the lateral edge of their free end in abutment against the opposite wall of the flanges 9*e*, 9*f*. In the region toward their free end, the diaphragm portions located at the opposite ends are placed in recesses formed in posts 12 integrally upstanding from the base 1. FIG. 6 shows that the diaphragm 6 is positioned at a level which is offset from the center of rotation O of the drum is order to achieve a satisfactory flipping effect of the diaphragm portions by the pins and to produce a clear tone. When assembling the diaphragm 6, if the rear edge thereof is strongly pushed inward, the diaphragm portions located at the opposite ends tend to creep along the peripheral surface of the steps 9*g*, 9*h*. To prevent such creeping of the diaphragm portions, the posts 12 provide abutment against which these diaphragm portions can rest in their region adjacent the free end thereof.

A pair of gears, one a small diameter gear 15 and one a large diameter gear 16 are integrally formed on a horizontal shaft 17 which is rotatably mounted adjacent the end of the drum 9 where the gear 9*b* is formed. The gear 15 meshes with the gear 9*b*. The combination of gears 15, 16 form a gear train which increases the speed, and their support shaft 17 is received in a pair of semicircular grooves formed in the free end faces of a pair of posts 13, 14 upstanding from the base 1. A pair of projections, only one being shown at 18 in FIG. 2, which are integral with the cover 2, bears against the end face of the posts 13, 14 to prevent a displacement of the shaft 17 out of the grooves.

Similarly, a speed-up gear train comprising a small diameter gear 19 and a large diameter gear 20 is rotatably mounted laterally of the gear train 15, 16. The gear train 19, 20 includes a shaft 21 which is received in semi-circular grooves formed in the end face of a pair of posts 22, 23 upstanding from the base 1. Again projections integral with the cover 2 bear against the end face of these posts to prevent a removal of the shaft 21 from the grooves. The gear 19 meshes with the gear 16 while the gear 20 meshes with a worm gear 25 which is integrally formed on a shaft 24 extending in a direction perpendicular to the shaft 21. The relation between the gear 20 and the worm gear 25 is such that the rotation of the shaft 24 occurs at a higher rate than that of the shaft 21. A shaft 24 is rotatably supported by the base 1 and the cover 2. The shaft 24 is integrally provided with a rotatable governor 28 carrying a plurality of brake members 27, formed of a rubber material, which tend to move radially outward into abutment against a circular wall 26 formed in the base 1 under the influence of the centrifugal force during the rotation thereof.

A shaft 29 is rotatably mounted and has its axis intersecting at right angles with an extension of the axis of the drum 9. The shaft 29 has its inner end loosely fitted in the base 1 while its upper end freely extends through the cover 2 so that the upper end can be manually rotated. The shaft 29 also freely extends through a disc 30 which is formed with a bevel gear 30*a* that in turn meshes with the bevel gear 9*a* on the drum 9. A helical spring 31 has its one end anchored to the shaft 29 and its other end engaged with a suitable projection formed on the base 1. A ratchet mechanism including a leaf spring 32 and ratchet teeth 30*b* is interposed between the shaft 29 and the disc 30. Specifically, leaf spring 32 includes an arcuately extending arm 32*a*, and has its one end fixedly fitted into the shaft 29 at a position where it bears against the upper surface of the disc 30. The free end of arm 32*a* abuts against one of ratchet teeth 30*b* which are formed on the disc 30 in the form of an annular series of ripples. When the shaft 29 is externally rotated in the clockwise direction, as viewed in FIG. 4, in order to charge the spiral spring, the end of leaf spring 32 slides over the ratchet teeth 30*b* without imparting any drive to the disc 30. On the other hand, when the shaft 29 rotates counterclockwise under the resilience of spring 31, the free end the arm bears against one of the ratchet teeth 30*b* to cause a substantially integral rotation of the disc 30 with the shaft 29.

Assuming that the spiral spring 31 is charged by externally rotating the shaft 29, the disc 30 rotates under the resilience of the spring 31, thus driving the drum 9 for rotation, through the bevel gear 30*a* on the disc 30 and its meshing gear 9*a*. This rotation is transmitted to the shaft 24 through the speed-up gear trains 9*b*, 15, 16, 19, 20 and 25, thus rotating the shaft 24 at a high speed. The rotation of the shaft 24 is controlled to a given value by the action of a governor assembly including the rotatable governor member 28 and the circular wall 26. As a consequence, the speed of rotation of the drum 9 is also controlled to a constant value. As the drum 9 rotates, the pins fixedly mounted on the periphery thereof flip a plurality of diaphragm portions 6*b* in accordance with the given program, thus sequentially producing different tones to play a musical piece. The sound produced by the diaphragm portions are transmitted to the resonating plates 4, 7 to cause a resonance thereof, and is also transmitted to the casing inclusive of the base 1 and cover 2 to cause a resonance thereof, thus giving off an amplified, clear tone externally.

Figure 5:
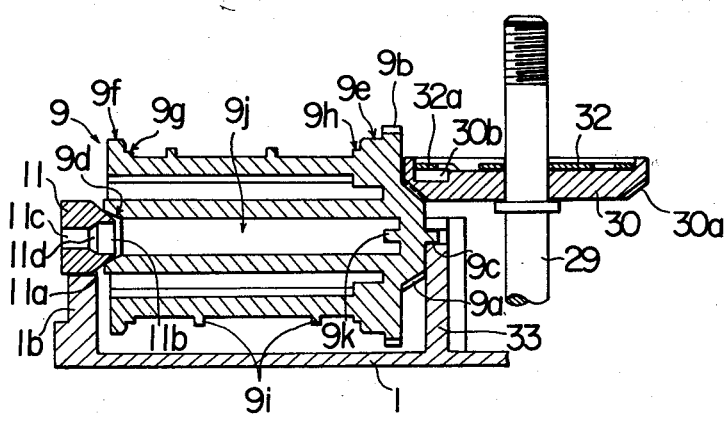
FIG. 5 is a cross section taken along the line V—V shown in FIG. 4.
Figure 11:
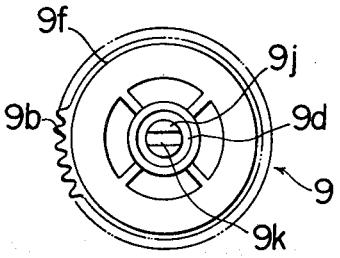
FIG. 11 is a left-hand side elevation of the drum.

As shown in FIGS. 5 and 11, a central bore 9*j* is formed within the drum 9 in alignment with the axis of rotation thereof and communicates with the axial bore 9*d*. At the opposite end, the drum is formed with a projection 9*k* which extends diametrically of the central bore 9*j*. The bearing 11 is formed with a hollow portion 11*b* of the same diameter as the central bore 9*j* in its end which forms the conical surface 11*a*, and is also formed with a hollow portion 11*c* of an inner diameter less than the hollow portion 11*b* in its opposite end. A conical step 11*d* is defined between the hollow portions 11*b* and 11*c*.

Figure 12:
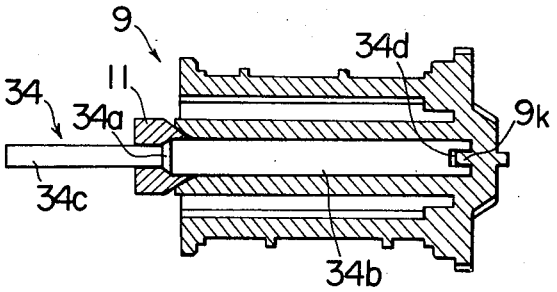
FIG. 12 is a cross section of the drum with an external output shaft mounted therein.

When the drum 9 and the bearing 11 are arranged in this manner, external output shaft can be easily mounted as illustrated in FIG. 12. In this Figure, an external output shaft 34 includes a large diameter portion 34*b* of the same profile as the central bore 9*j* and a small diameter portion 34*c* of the same diameter as the hollow portion 11*c*, which are connected together by a conical step 34*a*. A diametrical slitting 34*d* is formed in the end face of the portion 34*b*, Before the drum 9 is fitted over the bearing 11 or after the bearing 11 is removed from the peripheral wall 1*b* if the drum 9 is mounted on the bearing 11, the portion 34*b* is fitted into the central bore 9*j* to engage the projection 9*k* with the slitting 34*d*. Subsequently, the hollow bearing 11 is passed over the portion 34*c* of the output shaft 34, and is fixedly fitted in the peripheral wall 1*b*. In this manner, the shaft 34 is connected with the drum 9 substantially in an integral manner, and the portion 34*c* of the shaft may be connected with a desired external mechanism such as a drive mechanism which drives the hand or foot or doll as used in a music toy, for example. Since the step 34*a* of the shaft 34 is located in a manner corresponding to the step 11*d* of the bearing 11, a withdrawal of the shaft 34 is effectively prevented.

Figure 13:
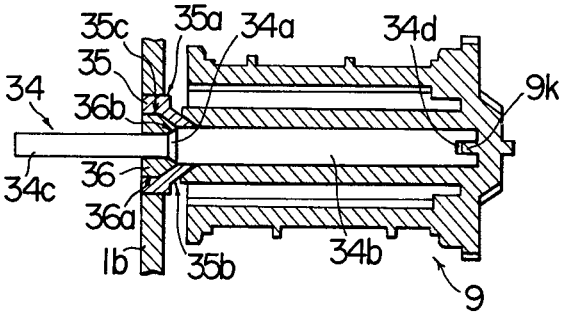
FIG. 13 is a cross section of another form of mounting structure for an external output shaft.

In the embodiment shown in FIGS. 5 and 12, it is necessary to dismount the hollow bearing 11 if it is attempted to assemble the shaft after the music box has been assembled. Such difficulty can be avoided with an embodiment shown in FIG. 13. In FIG. 13, the drum 9 and the output shaft 34 are constructed in the similar manner as before except that the hollow bearing is divided into two parts. Specifically, it comprises a first hollow bearing 35 which supports the large diameter portion 34*b* and a second hollow bearing 36 which supports the small diameter portion 34*c*. The first bearing 35 comprises a surface 35*a* which fits in the peripheral wall 1*b*, a conical surface 35*b* for fitting engagement with the conical bore 9*d*, and an opening 35*c* in which the second bearing 36 is fitted. The second bearing 36 comprises a surface 36*a* which fits in the opening 35*c*, and a conical surface 36*b* which bears against the step 34*a* of the output shaft 34. When the music box is to be used alone, only the first bearing 35 is used by placing it between the drum 9 and peripheral wall 1*b* in order to support the drum 9 in a rotatable manner. When an external output shaft is used in order to form a music toy, the large diameter portion 34*b* is inserted into the central bore 9*j* through the hollow portion of the bearing 35 while the drum 9 is supported by the first hollow bearing 35. The slitting 34*d* is engaged with the projection 9*k*. Subsequently, the second bearing 36 is fitted on the small diameter portion 34*c*, which is then fitted into the opening 35*c* of the first bearing 35, thereby assembling the output shaft with the drum 9 substantially in an integral manner while preventing a withdrawal of the output shaft 34.

Suitable means may be employed to engage the output shaft with the drum. By way of example, the central bore of the drum and the external output shaft which is fitted therein may have an identical polygonal cross section. If this configuration is employed, the opposite ends of the drum can be supported by hollow bearings, so that the shaft can be taken out of either end of the drum.

Figure 14:
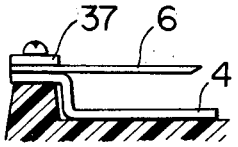
FIG. 14 is a side elevation of another form of mounting structure for resonating plate and diaphragm.
Figure 15:
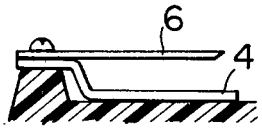
FIG. 15 is a side elevation of a further form of mounting structure for resonating plate and diaphragm.

FIG. 14 illustrates that one end of the diaphragm 6 may be screwed onto a single resonating plate 4 while using a retainer plate 37. FIG. 15 shows that one end of the diaphragm 6 may be fused or soldered to a single resonating plate 4 and is additionally screwed thereto, thus achieving an increased strength in connecting the resonate plate 4 and the diaphragm 6 together. Thus, the diaphragm can be firmly held in place by using a single resonating plate, eliminating the need to use a pair of resonating plates.

When securing the diaphragm within the casing, one of the resonating plates is secured to the base substantially in an integral manner and then the diaphragm and the other resonating plate are secured to the first plate as by a screw. This is desirable because the base is molded from synthetic resin material and hence if threads are formed therein, the latter may deform to reduce the fastening effect.

While specific embodiments of the invention have been shown and described in detail to illustrate the application of the principles of the invention, it will be understood that the invention may be embodied otherwise without departing from such principles.

What is claimed is:

1. A music box including a casing molded from synthetic resin material, a diaphragm secured to said casing with a metallic resonating plate interposed therebetween and fixed to said casing, and a drum having its peripheral surface located in opposing relationship with the free end of said diaphragm, said resonating plate being longer than said diaphragm and having at least a portion extending parallel to said diaphragm, said resonating plate extending over said drum and in close contact with said casing, said drum being pivotally supported to said casing.

2. A music box according to claim 1 in which the casing is provided with projections which position the resonating plate.

3. A music box according to claim 1 in which the resonating plate is fixedly connected at one end thereof with the diaphragm.

4. A music box according to claim 1 in which the resonating plate is roughened in its surface which is engaged by the diaphragm.

5. A music box according to claim 1; including a second resonating plate fixed to said diaphragm.

6. A music box according to claim 1 in which the casing is provided with post means which prevent the diaphragm from creeping along the periphery of the drum.

7. A music box according to claim 1 in which the free end of the resonating plate is folded to bear against the casing.

8. A music box according to claim 1 in which the drum is formed with a central bore in alignment with the axis of rotation thereof for receiving an external output shaft.

9. A music box according to claim 8 in which the drum has a central bore formed with an anchorage of an external output shaft.

10. A music box according to claim 8 in which the drum has a central bore engaged by a hollow bearing.

11. A music box construction comprising a synthetic resin housing defining a sound resonation space, a metal resonating plate connected to said housing in said space having portions in firm contact with said housing, a flexible metal diaphragm having one end firmly abutting and secured to one end of said resonating plate and an opposite end spaced from said resonating plate with at least one diaphragm portion thereat, a drum rotatably mounted to said housing adjacent said diaphragm portion having at least one pin contactable with and movable past said diapragm portion to cause said diaphragm portion to vibrate and produce sound, said resonating plate extending parallel to said diaphragm and therebeyond over said drum, and drive means connected to said drum to rotate said drum, wherein sound produced by said diaphragm portion is amplified, enriched and transmitted to said housing by said resonating plate.

12. A music box construction according to claim 11, wherein said resonating plate includes oppositely bent folds extending obliquely and parallel across said plate adjacent its end connected to said diaphragm, said housing including a step raised inwardly toward said space, said plate end connected to said diaphragm securely connected to said raised step.

13. A music box construction according to claim 12, wherein said resonating plate further includes an upstanding piece connected to an end of said resonating plate opposite to the end connected to said diaphragm, said housing including a projecting step, said upstanding piece firmly abutting against said projecting step, said resonating plate being in firm abutment with said housing in its area between said obliquely extending folds and said upstanding piece.

14. A music box construction according to claim 13, further including a second resonating plate substantially similar to said first resonating plate connected to said housing over said diaphragm and facing said first-mentioned resonating plate.

15. A music box construction according to claim 11, wherein said resonating plate is made of metal substantially thicker than the metal of said diaphragm.

16. A music box construction according to claim 11, wherein said drum includes a central cylindrical portion defining a central bore, a projection of said drum extending axially into one end of said central bore, an opposite end of said central bore being open and adjacent a wall of said housing, an opening in said housing wall adjacent said central bore opening, and a bearing member positioned in said housing wall opening having a portion engaged with said drum central portion and including a bore axially aligned with said central bore of said drum.

17. A music box construction according to claim 16 further including an output shaft having a portion positioned within said central bore and including a slit opening engageable with said drum projection in said central bore, said output shaft including a portion extending through said bore in said bearing member and outwardly of said housing.

18. A music box construction according to claim 17 wherein said bearing member bore includes an increased diameter portion adjacent said drum and a reduced diameter portion spaced from said drum, said output shaft portion extending out of said housing being of a reduced diameter slightly smaller than said reduced diameter portion of said bearing bore and having said portion disposed in said central bore of said drum of a diameter slightly smaller than said increased diameter portion of said bearing bore, whereby said output shaft is retained within said drum.

* * * * *